United States Patent [19]

Wesson et al.

[11] Patent Number: 4,693,314

[45] Date of Patent: Sep. 15, 1987

[54] LOW ACTUATION PRESSURE BAR VENT

[75] Inventors: David S. Wesson, Katy, Tex.; Stanley J. Wall, Oxnard; John H. Hales, Ventura, both of Calif.

[73] Assignee: Halliburton Company, Duncan, Okla.

[21] Appl. No.: 831,237

[22] Filed: Feb. 18, 1986

[51] Int. Cl.[4] ..... E21B 34/06

[52] U.S. Cl. ..... 166/317; 166/318; 166/373

[58] Field of Search ..... 106/317, 318, 373, 297, 106/386, 194

[56] References Cited

U.S. PATENT DOCUMENTS

| | | | |
|---|---|---|---|
| 3,871,448 | 3/1975 | Vann et al. | 166/128 |
| 4,151,880 | 5/1979 | Vann | 166/314 |
| 4,299,287 | 11/1981 | Vann et al. | 166/297 |
| 4,330,039 | 5/1982 | Vann et al. | 166/297 |
| 4,434,854 | 3/1984 | Vann et al. | 166/386 |
| 4,512,406 | 4/1985 | Vann et al. | 166/297 |
| 4,576,233 | 3/1986 | George | 166/297 |
| 4,603,741 | 8/1986 | Edgmon | 166/317 |

*Primary Examiner*—Stephen J. Novosad
*Assistant Examiner*—Bruce M. Kisliuk
*Attorney, Agent, or Firm*—James R. Duzan

[57] ABSTRACT

A low actuation pressure bar vent for use in a tool string having low pressure therein. The vent includes a body portion and a piston slidingly disposed in the body. The piston and body define a first cavity therebetween and a second cavity therebetween, spaced from the first cavity. The body further defines a plurality of transverse ports therethrough providing communication between a body central opening and a well annulus. When in a closed position, the piston sealingly closes the ports. In a first embodiment, the first cavity has a spring disposed therein. The body also defines a second plurality of ports therein providing fluid communication between the first cavity and the well annulus. Pressure in the well annulus and the spring bias the piston toward an open position uncovering the ports. In an alternate embodiment, a pressurized gas biases the piston. The second cavity is filled with a fluid such that movement of the piston is prevented. A break plug is positioned in the piston and includes a shearable portion, which when sheared, allows the fluid in the second cavity to be released to the tubing string. The biasing force moves the piston to the open position, displacing the fluid from the second cavity. During assembly, an assembly plug holds the piston closed.

15 Claims, 6 Drawing Figures

LOW ACTUATION PRESSURE BAR VENT

BACKGROUND OF THE INVENTION

1. Field Of The Invention

This invention relates to vents used to vent high pressures below a packer in a well, adjacent a producing formation, and more particularly, to a pressure and bar actuated vent which may be opened even when there is low pressure in the tubing string.

2. Description Of The Prior Art

A relatively high pressure and bar actuated vent is disclosed in co-pending U.S. patent application Ser. No. 425,626, filed Sept. 28, 1982, assigned to the assignee of the present invention. This apparatus includes a body with a piston slidingly disposed therein having an air chamber sealed by a break plug. A firing bar is passed through the tubing string to fire the perforating guns below the vent, and the bar breaks the plug as it passes through the vent. This opens the chamber to pressure in the tubing string. This fluid pressure acts on a shoulder on the piston forcing the piston to move and align ports thereon with production ports in the body. An improved version, shown in GeoVann Drawing No. 20-2482, has a piston which simply uncovers ports in the body when in the open position. A disadvantage to these apparatus is that the tubing must have some fluid in it for actuation. In fact, it is not recommended that these vents be used with less than 500 psi total pressure inside the tubing.

Another vent which is actuated by pressure applied in the tubing string is shown in U.S. Pat. Nos. 4,330,039 and 4,434,854 to Vann et al.

To solve the problem of low pressure tubing situations, a bar-actuated vent having a collet-type opening sleeve has been developed, as disclosed in U.S. Pat. No. 4,512,406 to Vann et al. For this apparatus, a special bar is dropped down the tubing which engages collet fingers and moves a valve sleeve to an open position uncovering ports in the body. After the sleeve has moved a predetermined distance, the collet fingers release the bar which then travels down the tubing string. A problem with this device is that the bars sometimes hang up inside the tool, which requires a separate operation to retrieve it and redrop it.

Other mechanically actuated vents are shown in U.S. Pat. Nos. 3,871,448 to Vann et al; 4,151,880 to Vann; and 4,299,287 to Vann et al.

The present apparatus solves the problems previously known by providing a low actuation pressure bar vent having a piston which can be opened by biasing means such as the force of a spring and the hydrostatic pressure in the well bore, or such as a pressurized gas chamber providing a force on the piston.

SUMMARY OF THE INVENTION

The low actuation pressure and bar actuated vent of the present invention comprises body means, defining a central opening therethrough, attachable to a tool string and having port means thereon for providing communication between a well annulus and the central opening, piston means reciprocably disposed in the body means central opening and having a closed position covering the port means and an open position, biasing means for biasing the piston means from the closed position toward the open position, balancing means for balancing the biasing means and thereby maintaining the piston means in the closed position, and releasing means for releasing the balancing means and thereby allowing the biasing means to move the piston means to the open position. The piston means has a central opening therethrough in communication with the body means central opening.

In the preferred embodiment, the balancing means comprises fluid reservoir means between the body means and piston means with a volume of fluid disposed therein, and sealingly enclosed thereby, said fluid holding the piston means in the closed position, and preventing movement thereof by the biasing means.

The releasing means for releasing the fluid from the fluid reservoir means is characterized by a break plug comprising a body portion defining a cavity therein in communication with the fluid reservoir means, and a shear portion extending from the body portion into the piston means central opening and being shearable by a bar passed through the tubing string. When the shear portion is sheared, the cavity in the body portion of the shear plug is thereby placed in communication with the central opening for releasing fluid therethrough. The force of the biasing means moves the piston toward the open position and displaces the fluid from the fluid reservoir means.

In a first embodiment, the biasing means comprises a spring. Preferably, the body means also includes a port therein in communication with a well annulus and adjacent the piston means such that the biasing means further comprises pressure in the well annulus acting on shoulder means on the piston means for providing a force for biasing the piston means from the closed toward the open position, thus assisting the spring.

In an alternate embodiment, the biasing means comprises gas reservoir means between the body means and piston means, spaced from the fluid reservoir means, and a volume of pressured gas disposed in the gas reservoir means, and sealingly enclosed thereby. The piston means is thus biased by gas pressure in the gas reservoir means, and is moved in response to this pressure when the releasing means releases the balancing means.

The apparatus further comprises shoulder means for limiting movement of the piston means.

The body means is best characterized by an elongated body attachable to upper and lower tool string portions, and the piston means is best characterized by a piston or sleeve slidably disposed in the body such that the body and piston define a first cavity therebetween and a second cavity therebetween spaced from the first cavity. Preferably, the biasing means is disposed in the first cavity, and the balancing means is disposed in the second cavity.

An important object of the present invention is to provide a low actuation pressure and bar actuated vent which can be opened under low pressure conditions in the tubing string.

Another object of the invention is to provide a low actuation pressure and bar actuated vent utilizing the force from a spring and hydrostatic pressure in the well bore to open the vent.

Still another object of the present invention is to provide a vent using force exerted by a pressurized gas chamber to open the vent.

A further object of the present invention is to provide a low actuation pressure and bar actuated vent using fluid contained in a chamber to maintain a piston in a closed position, and providing means for releasing the fluid such that biasing means can open the valve.

Additional objects and advantages of the invention will become apparent as the following detailed description of the preferred embodiments is read in conjunction with the accompanying drawings which illustrate such preferred embodiments.

DESCRIPTION OF THE PREFERRED EMBODIMENT

Figure 1A:
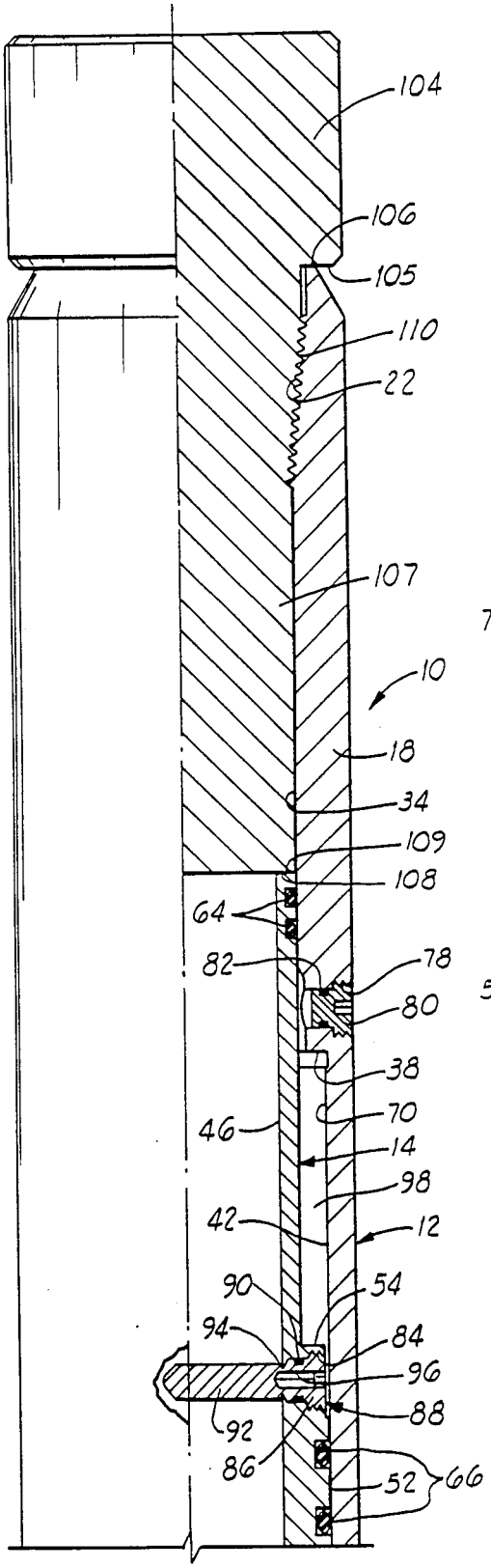
FIGS. 1A–1B illustrate a first embodiment of the low actuation pressure and bar actuated vent of the present invention in a closed position with an assembly plug installed therein.
Figure 1B:
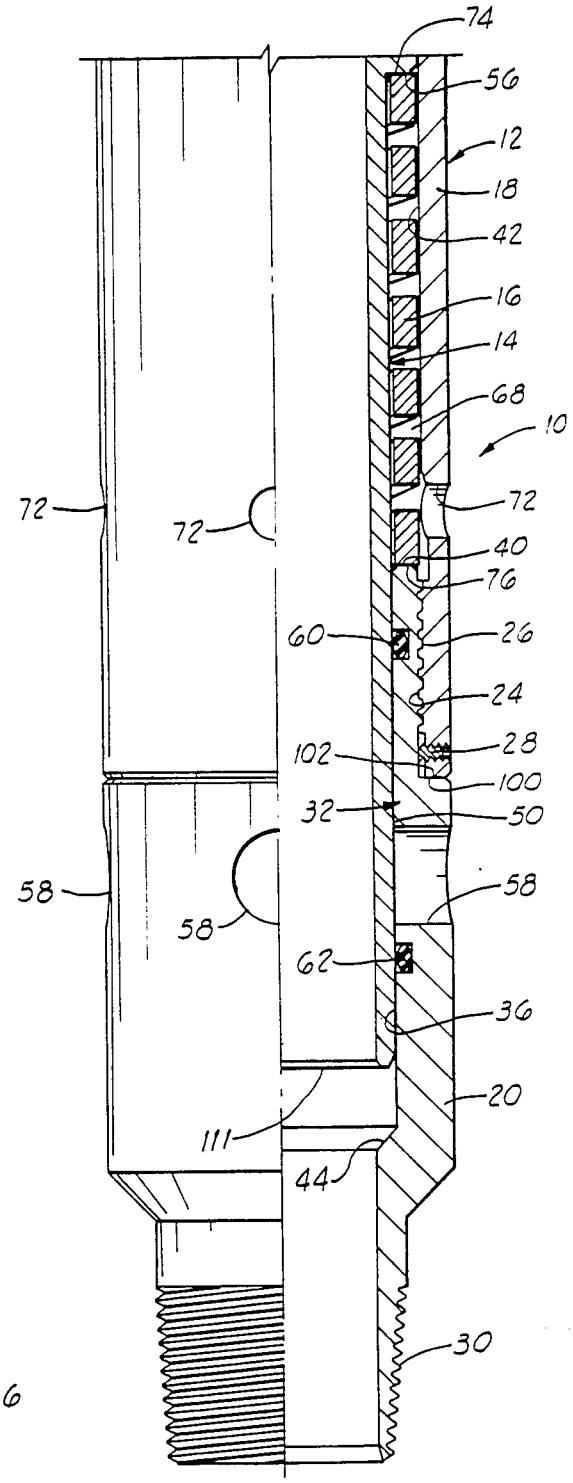

Referring now to the drawings, and particularly to FIGS. 1A and 1B, a first preferred embodiment of the low actuation pressure and bar actuated vent of the present invention is shown and generally designated by the numeral 10. The major components of bar vent 10 are a body portion 12, piston portion 14 and a spring 16.

Body portion 12 comprises an upper housing 18 and a lower coupling 20. Housing 18 has a threaded upper end 22 adapted for attachment to an upper tool string portion. A lower end 24 of housing 18 is threadingly engaged with upper end 26 of lower coupling 20. Preferably, the threads are of the Acme type, although it will be seen by those skilled in the art that other threads would also be usable. A set screw 28 is threaded into housing 18 to lockingly bear against coupling 20 so that undesired relative rotation thereof is prevented. Coupling 20 has a threaded lower end 30 attachable to a lower tool string portion.

Body portion 12 defines a central opening 32 longitudinally therethrough. Central opening 32 includes a relatively small diameter portion 34 defined by an upper portion of housing 18 and a relatively small diameter portion 36 defined by coupling 20. Extending radially outwardly from small diameter portion 34 in housing 18 is an annular shoulder 38, and a similar annular shoulder 40, formed by coupling 20, extends radially outwardly from small diameter portion 36. Central opening 32 thus also includes a large diameter portion 42 extending between shoulders 38 and 40. A chamfered shoulder 44 extends radially inwardly from small diameter portion 36 at a lower end thereof.

Piston or sleeve portion 14 is slidingly disposed in central opening 32 of body portion 12, and the piston portion defines a central opening 46 longitudinally therethrough which is in communication with central opening 32 in the body. Central opening 46 is of substantial constant diameter.

Piston 14 includes a small diameter upper portion 48 dimensioned to closely fit within small diameter portion 34 in housing 18, a small diameter lower portion 50 which is dimensioned to closely fit within small diameter portion 36 of coupling 20 and a large diameter portion 52 having an upper annular shoulder 54 and a lower annular shoulder 56. Large diameter portion 52 is dimensioned to closely fit within large diameter portion 42 of housing 18.

Body portion 12 also defines a plurality of transverse ports 58 therein providing communication between central opening 32 and the exterior of body portion 12. As shown in FIGS. 1A–1B, piston 14 is in a downward, closed, first position in which small diameter portion 50 of the piston covers and closes ports 58. Seal means, such as O-rings 60 and 62, are provided in coupling 20 above and below transverse ports 58. Thus, when piston 14 is in the closed position, central opening 46 thereof is sealingly separated from ports 58.

Seal means, such as O-rings 64, are provided in upper portion 48 of piston 14 to seal on small diameter portion 34 of housing 18. Similarly, seal means, such as O-rings 66, are provided in large diameter portion 52 of piston 14 for sealing on large diameter portion 42 of housing 18. It will thus be seen that piston 14 and body portion 12 define a first, lower annular cavity 68 therebetween sealed at its upper end by O-ring 66 and at its lower end by O-ring 60. Piston 14 and body 12 also define a second, upper annular cavity 70 therebetween sealed at its upper end by O-ring 64 and at its lower end by O-ring 66. Thus, first cavity 68 and second cavity 70 are spaced apart and separated by large diameter portion 52 of piston 14. Housing 18 defines a plurality of ports 72 therethrough which provide fluid communication between first cavity 68 and the exterior of apparatus 10.

Spring 16 is annularly disposed in first cavity 68 and has an upper end 74 in contact with shoulder 56 and a lower end 76 in contact with shoulder 40. Preferably, spring 16 is a helically coiled compression spring formed of substantially rectangular cross-sectional wire.

A threaded opening 78 extends through housing 18 and is in communication with second cavity 70. Normally installed in opening 78 is a plug 80 sealed by an O-ring 82.

At a lower end of cavity 70, and in communication therewith, a threaded opening 84 extends through piston 14. A body portion 86 of a break plug 88 is engaged with opening 84. Sealing means, such as O-ring 90, seals therebetween. Extending radially inwardly from body portion 86 and break plug 88 is a shearable portion 92. It will be seen that shear portion 92 extends well into central opening 46 of piston 14 and has a sharp undercut 94 on an outer surface thereof. Shear plug 88 defines a cavity 96 through body portion 86 thereof, and the cavity extends radially inwardly beyond undercut 94 into shearable portion 92.

Cavity 70 is filled with a volume of substantially incompressible fluid 98, and thus provides fluid reservoir means. It will be seen that in the closed position shown in FIGS. 1A–1B, O-rings 64, 66, 82 and 84 prevent the escape of fluid 98 from cavity 70. It will be seen by those skilled in the art that fluid 98 thus prevents movement of piston 14 and maintains the piston in the closed position, even though spring 16 exerts a force on the piston. Thus, balancing means are provided for balancing the force exerted by the biasing means of the spring and annulus pressure.

ASSEMBLY OF THE FIRST EMBODIMENT OF THE APPARATUS

Before assembly, housing 18 and coupling 20 of body portion 12 are separated. At this point, plug 80 is not installed in opening 78 in housing 18, and no fluid 98 is present in second cavity 70. Piston 14 is longitudinally positioned in housing 18 such that upper shoulder 54 of the piston is in contact with shoulder 38 in housing 18. Spring 16 is then placed in its annular position such that upper end 74 thereof bears against shoulder 56 of piston 14.

Threaded end 26 of coupling 20 may then be threadingly engaged with threaded end 24 of housing 18.

Preferably, the length of threaded end 26 of coupling 20 and threaded end 24 of housing 18 is sufficiently long such that spring 16 does not extend beyond the lower end of the housing when the spring is at its free height. In other words, with spring 16 uncompressed, threaded end 26 of coupling 20 will have at least one thread engageable with the first thread in threaded end 24 of housing 18 without the necessity of precompression of spring 16. As coupling 20 is threaded onto housing 18, shoulder 40 on the coupling bears against lower end 76 of spring 16, and compresses the spring. Coupling 20 is threaded until shoulder 102 thereon engages lower end 100 of housing 18. At this time, set screw 28 may be put in place.

At approximately the same time as coupling 20 is engaged with housing 18, an assembly plug 104 is threadingly engaged with threaded opening 22 of the housing. Assembly plug 104 has a shoulder 105 thereon adapted for contacting upper end 106 of housing 18. Assembly plug 104 further has a substantially cylindrical lower portion 107 having a lower end 108 adapted for contacting upper end 109 of piston 14. Threaded portion 110 on assembly plug 104 is adapted to loosely engage threaded upper end 22 of housing 18, thus assuring that shoulder 105 on the assembly plug properly contacts upper end 106 on the housing.

With piston 14 thus positioned as shown in FIG. 1A and 1B, upper cavity 70 is filled with fluid 98 through opening 78. When cavity 70 is filled, plug 80 is engaged with opening 78 for closure of the cavity.

Fluid 98 is preferably a silicone oil having a viscosity range of approximately 50 to 400 centistokes. High temperature conditions in the well bore will tend to expand fluid 98, and high pressure conditions in the well bore will tend to compress the fluid. Preferably, fluid 98 is chosen such that the total change in volume thereof due to temperature and pressure is minimized. When apparatus 10 is in the closed position, lower end 111 of piston 14 is spaced from chamfered shoulder 44 in lower coupling 20 of body portion 12, as best shown in FIG. 1B. If the expansion of fluid 98 due to temperature is greater than the corresponding compression due to high pressure in the well bore, piston 14 will be displaced downwardly toward shoulder 44. The spacing of lower end 111 from shoulder 44 provides compensation for such expansion.

Assembly plug 104 must obviously be removed before vent assembly 10 can be attached to the tubing string, and when removed, fluid 98 will maintain piston 14 in the closed position as hereinbefore described.

While the above-described assembly method is preferred, other assembly techniques could also be used. For example, prior to installation of assembly plug 104, a fluid pressure line could be attached to threaded opening 78 in housing 18 with fluid 98 then pumped through opening 78, causing piston 14 to move to the closed position covering ports 58. The fluid would thus fill first cavity 70. At this time, assembly plug 104 could be threadedly engaged with threaded opening 22 of housing 18. The pressure line then could be removed from opening 78, with assembly plug 104 holding piston 14 in a closed position, as shown in FIGS. 1A and 1B. The level of fluid 98 in cavity 70 could then be topped off, and plug 80 installed for closure of cavity 70.

OPERATION OF THE PREFERRED EMBODIMENT OF THE APPARATUS

Figure 2A:
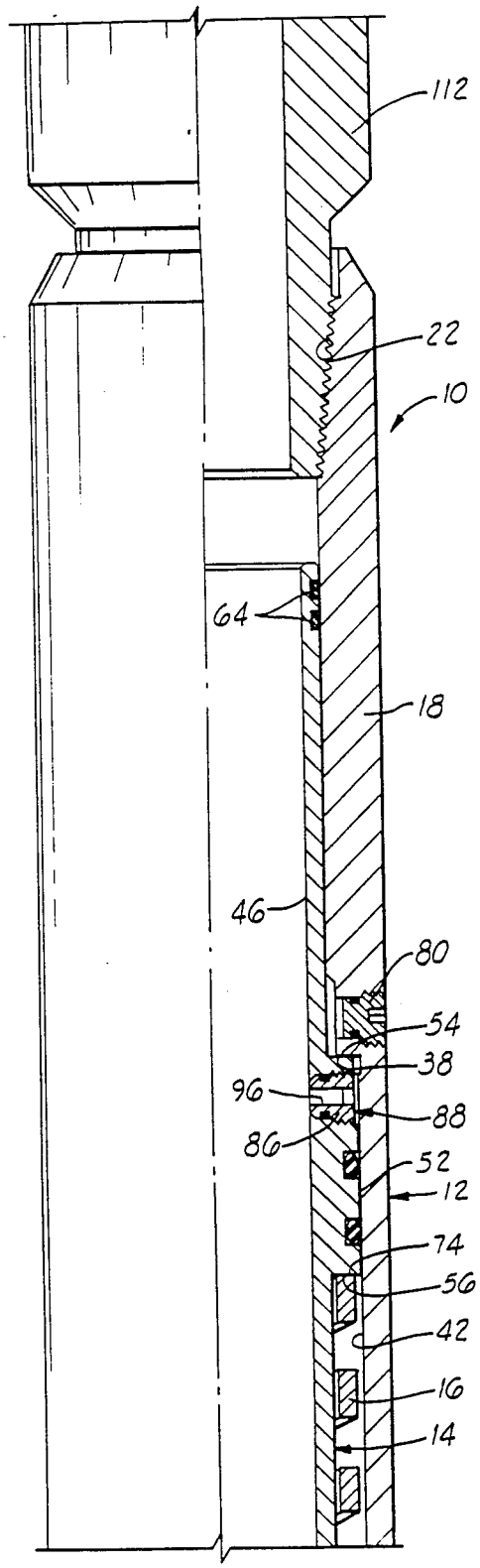
FIGS. 2A–2B show the first embodiment installed in a tubing string and in an open position.
Figure 2B:
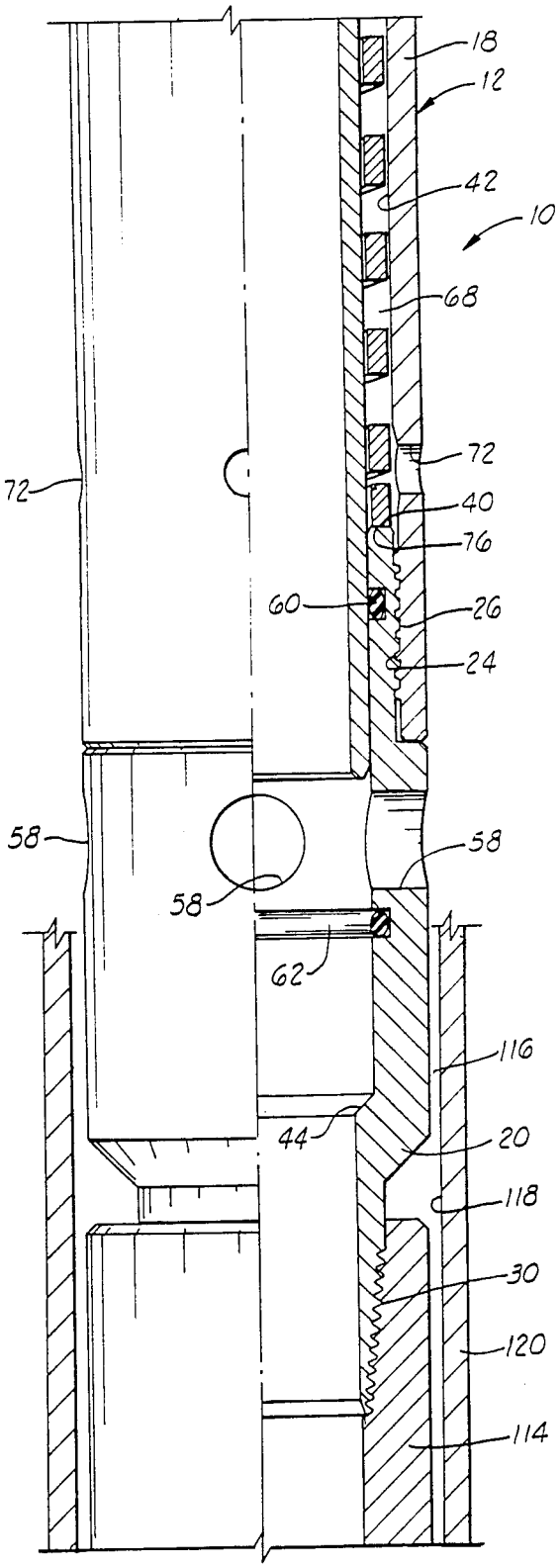

Referring now to FIGS. 2A and 2B, in operation, vent apparatus 10 is installed such that upper end 22 of housing 18 of body portion 12 is engaged with an upper tool string portion 112, after assembly tool 104 is removed. Similarly, lower end 30 of coupling 20 of body portion 12 is attached to lower tool string portion 114. A packer of a kind known in the art is positioned in the tool string above vent apparatus 10, and a perforating tool of a kind known in the art is positioned below vent apparatus 10 in the tubing string. The tubing string is then run down a hole such that the perforating tool is adjacent the formation through which production is to be carried out. In this operating position, an annulus 116 is defined between body portion 12 of vent apparatus 10 and well bore 118 defined by casing 120.

In this operating position, it will be clear to those skilled in the art that the hydrostatic pressure in annulus 116 is also in first cavity 68 because ports 72 provide communication therebetween. It will also be clear to those skilled in the art that this hydrostatic pressure exerts an upward force on shoulder 56 of piston 14 in addition to the upward force exerted by compressed spring 16. However, fluid 98 sealingly contained in cavity 70 still prevents upward movement of piston 14 and therefore prevents opening of ports 58.

To fire the guns in the perforating tool, a firing bar is dropped through the tubing string. As the firing bar (not shown) passes through apparatus 10, it contacts shearable portion 92 of break plug 88 and shears shearable portion 92 from body portion 86 approximately along undercut 94. The firing bar then passes downwardly to the perforating tool to carry out its normal functions.

After shearable portion 92 is sheared from break plug 88, cavity 96 is opened such that fluid communication is provided between central opening 46 of piston 14 and second cavity 70. The combined forces of spring 16 and the hydrostatic pressure in the first cavity 68 are more than sufficient to force piston 50 upwardly, displacing fluid 98 from cavity 70 through cavity 96, thereby uncovering and opening ports 58. Piston 14 stops at a fully open position when shoulder 54 thereof contacts shoulder 38 in mandrel 18. When ports 58 are uncovered and apparatus 10 is in an open position, production fluids in annulus 116 may flow therethrough and upwardly through the tubing string.

DESCRIPTION OF AN ALTERNATE EMBODIMENT

Figure 3A:
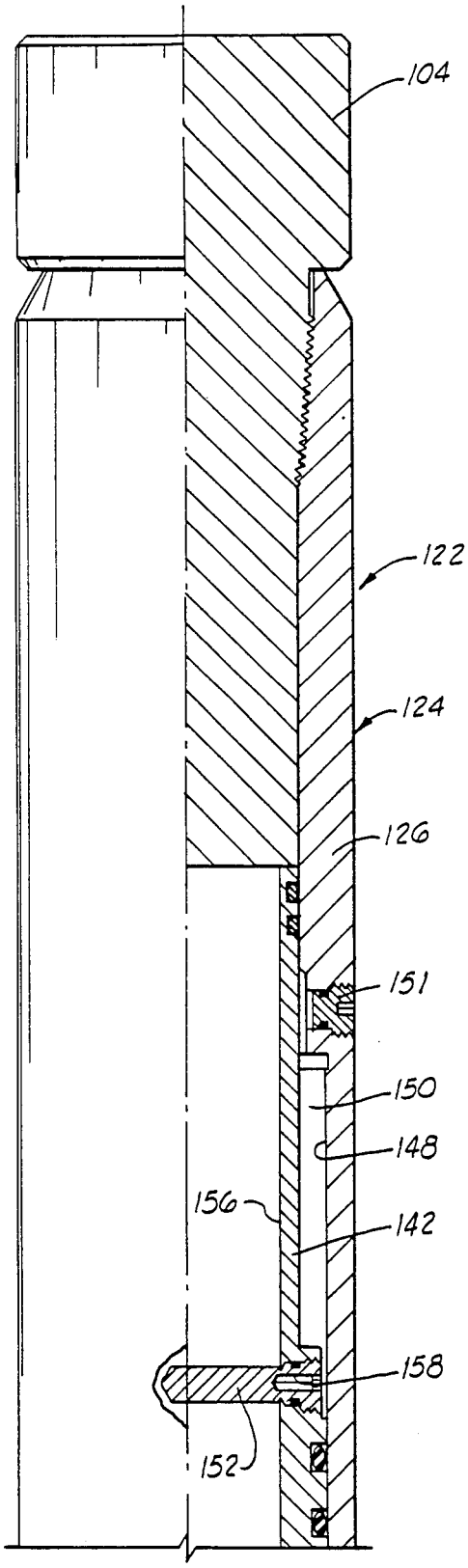
FIGS. 3A–3B show an alternate embodiment of the present invention in a closed position.
Figure 3B:
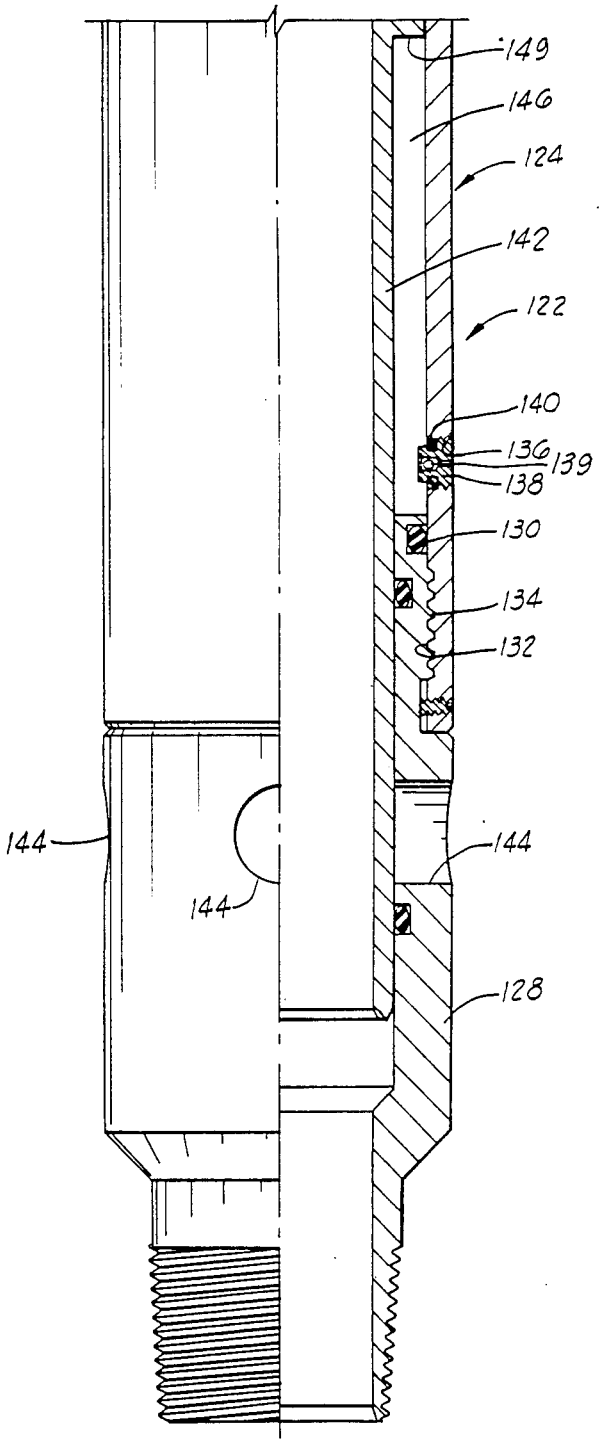

Referring now to FIGS. 3A and 3B, an alternate embodiment of the invention is shown and generally designated by the numeral 122. As with the first embodiment, alternate embodiment 122 comprises a body portion 124 including an upper housing 126 and a lower coupling 128. Upper housing 126 and lower coupling 128 are very similar to upper housing 18 and lower coupling 20 of the first embodiment except that they are adapted for providing sealing means, such as O-ring 130, therebetween. O-ring 130 is illustrated as disposed above threaded portion 132 of upper housing 126 and threaded portion 134 of lower coupling 128, but can be positioned in any convenient location as is known in the art.

Upper housing 126 includes a threaded opening 136 in which is placed a plug 138 sealed by sealing means, such as O-ring 140. Plug 138 preferably includes a check valve 139 therein.

Reciprocably disposed in body 126 is piston 142, essentially identical to piston 14 in the first embodiment. As shown in FIGS. 3A and 3B, piston 142 is in a closed position, covering ports 144 and lower coupling 128 in a manner similar to the first embodiment.

Piston 142 and body portion 124 define a lower, first annular cavity 146 and a second, upper annular cavity 148 sealingly separated from the lower cavity.

Lower cavity 146 is filled with a volume of compressible gas, such as nitrogen. Check valve 139 in plug 138 allows flow of the compressible gas through plug 138 into lower cavity 146 while preventing escape of gas therefrom. Cavity 146 therefore provides gas reservoir means. The gas in lower cavity 146 is pressurized such that it provides a biasing force on shoulder 149 of piston 144, thus providing biasing means for biasing the piston from the closed to open position.

Upper cavity 148 is identical in construction to upper cavity 70 in the first embodiment and is similarly filled with a volume of fluid 150 which again acts as a balancing means. Preferably, in the second embodiment, fluid 150 in upper cavity 148 is a compressible gas, such as nitrogen, identical to the gas filling lower cavity 146. It will thus be seen by those skilled in the art that the pressures in lower cavity 146 and upper cavity 148 are equalized, and piston 142 will be held in the closed position shown in FIGS. 3A and 3B. If such a compressible gas is used for fluid 150, plug 151 would also include a check valve, similar to check valve 139 in plug 138. However, fluid 150 could also be a silicone oil just as in the first embodiment. In such a case, plug 151 would be solid as shown in FIG. 3A. A break plug 152 provides means for releasing the fluid from cavity 148 when the break plug is sheared, just as in the first embodiment.

ASSEMBLY OF THE ALTERNATE EMBODIMENT OF THE APPARATUS

Assembly of the alternate embodiment is essentially the same as that of the first embodiment, except that no spring is positioned in lower cavity 146. As with the first embodiment, assembly plug 104 is used to facilitate assembly and physically hold piston 142 in the closed position during shipment. Upper cavity 148 is filled with fluid 150, whether a compressed gas, silicone oil, or other fluid, and lower cavity 146 is pressurized with gas.

OPERATION OF THE ALTERNATE EMBODIMENT OF THE APPARATUS

Alternate embodiment 122 of the vent apparatus is installed in a tool string in a manner identical to that of the first embodiment, as shown in FIGS. 2A and 2B.

After the shearable portion of break plug 152 is sheared, upper cavity 148 is opened such that fluid communication is provided with central opening 156 of piston 142 through cavity 158 in break plug 152. The force exerted on shoulder 149 of the piston by the pressurized gas in lower cavity 146 is sufficient to force piston 142 upwardly, displacing fluid 150 from cavity 148 through cavity 158, thereby uncovering and opening ports 144 in body portion 124. As with the first embodiment, when ports 144 are uncovered and alternate embodiment 122 is in an open position, production fluids in the well annulus may flow through ports 144 and upwardly through the tubing string.

It can be seen, therefore, that the low pressure and bar actuated vent of the present invention is well adapted to carry out the ends and advantages mentioned, as well as those inherent therein. While presently preferred embodiments of the apparatus, and of methods of assembly thereof, are discussed for the purposes of this disclosure, it will be seen that numerous changes in the construction of parts may be made by those skilled in the art. Such changes are encompassed in the scope and spirit of the appended claims.

What is claimed is:

1. A tubing vent comprising:

body means, defining a central opening therethrough, attachable to a tool string and having port means thereon for providing a communication between a well annulus and said central opening;

piston means reciprocably disposed in said body means central opening and having a closed position covering said port means and an open position;

biasing means for biasing said piston means toward said open piston;

balancing means for balancing said biasing means and for maintaining said piston in said closed position, said balancing means comprising:

fluid reservoir means between said body means and piston means; and a volume of fluid disposed in said fluid reservoir means, and sealingly enclosed therby for preventing movement of said piston means from said closed position;

location means for locating and maintaining said piston means in said closed position such that at least a portion of said fluid may be added to said fluid reservoir means, said location means being removable prior to attaching said body means to said tubing string;

and releasing means for releasing said balancing means and for allowing said biasing means to move said piston means from said closed position to said open position.

2. The vent of claim 1 wherein said releasing means is characterized by a break plug comprising:

a body portion defining a cavity therein in communication with said fluid reservoir means; and a shear portion extending from said body portion into said central opening and being shearable by a bar passed through said tubing string, such that when said shear portion is sheared, said cavity is placed in communication with said central opening for releasing said fluid therethrough.

3. The vent of claim 1 wherein said fluid is a silicone oil.

4. The vent of claim 1 wherein said biasing means comprises a spring.

5. The vent of claim 1 wherein said body means further includes a port therein in communication with said annulus and adjacent said piston such that at least a portion of said biasing means comprises pressure in said annulus providing a force for said biasing of said piston means.

6. The vent of claim 1 wherein said biasing means comprises:

gas reservoir means between said body means and piston means; and a volume of pressurized gas disposed in said gas reservoir means, and sealingly enclosed thereby.

7. The vent of claim 1 wherein said location means comprises a plug threadingly engageable with said body means.

8. A vent apparatus for use in a tubing string said apparatus comprising:

a body defining a longitudinally central opening therethrough and a transverse port therein communication with said central opening and a well annulus around said body;

a piston slidingly disposed in said body central opening, said body and piston defining a first cavity therebetween and a second cavity therebetween spaced from said first cavity, said piston having a first position closing said port and a second position opening said port;

biasing means disposed in said first cavity for exerting a force on said piston and thus biasing said piston from said first position toward said second position;

balancing means disposed in said second cavity for balancing said force exerted by said biasing means and thereby maintaining said piston in said first position;

said balancing means comprising:

a fluid sealingly enclosed in said second cavity such that said piston is prevented from movement by said biasing means;

an assembly plug engageable with said body for temporarily balancing said force of said biasing means while at least a portion of said fluid is placed in said second cavity, said assembly plug being removable prior to operation of said apparatus; and releasing means for releasing said balancing means, resulting in said biasing means moving said piston to said open position and allowing flow from said annulus through said port into said tubing string.

9. The apparatus of claim 8 wherein said biasing means comprises a spring disposed in said first cavity.

10. The apparatus of claim 8 wherein said biasing means comprises:

said body defining another port therethrough in communication with said first cavity and said annulus; and shoulder means on said piston responsive to fluid pressure in said annulus.

11. The apparatus of claim 8 wherein said biasing means comprises:

a pressurized gas filling said first cavity; and shoulder means on said piston responsive to a pressure of said gas.

12. The apparatus of claim 8 wherein said fluid is a silicone oil.

13. The apparatus of claim 8 wherein said releasing means comprises a shear plug for providing communication between said second cavity and said tubing string when sheared and for displacing said fluid from said second cavity therethrough by movement of said piston to said second position as a result of said force of said biasing means.

14. A low actuation pressure bar vent for use in a tubing string which is substantially dry, said vent comprising:

an elongated body adapted for positioning in said tubing string and defining a central opening therethrough and a transverse port therein, said transverse port being in communication with said central opening;

an elongated piston slidingly disposed in said body and defining a central opening therethrough in communication with said body central opening, said piston having a closed position covering said port and on open position, wherein said piston and said body define a first, annular cavity therebetween and a second, annular cavity therebetween sealingly separated from said first cavity;

a fluid filling said second cavity such that movement of said piston from said closed to open positions is prevented;

a compression spring disposed in said first cavity and tending to move said piston from said closed to said open position;

an assembly plug attachable to said body for holding said piston in said closed position and for locating said piston with respect to said body while said second cavity is filled with said fluid, said assembly plug being removed prior to positioning said body in said tool string;

and a fluid releasing plug defining a cavity therein in communication with said second cavity and having a shearable portion extending into said piston central opening, said cavity in said plug providing communication between said second cavity and said piston central opening when said shearable portion thereon is sheared, whereby said fluid is displaced from said second cavity into said piston central opening by movement of said piston to said open position by said spring.

15. The vent of claim 14 wherein said body defines a pressure port therein, said pressure port being in communication with said first cavity and said annulus, such that pressure in said annulus is applied to said piston, providing additional force tending to move said piston to said open position.

* * * * *